United States Patent [19]

Maruoka et al.

[11] Patent Number: 4,698,102

[45] Date of Patent: Oct. 6, 1987

[54] PROCESS FOR PRODUCING, BY CONTINUOUS ANNEALING, SOFT BLACKPLATE FOR SURFACE TREATMENT

[75] Inventors: Kuniaki Maruoka; Nobuyuki Takahashi; Senkichi Tujimura; Yasuhiko Yamashita; Setsuo Otsuka; Isao Oohasi; Takeo Motoyama, all of Kitakyushu, Japan

[73] Assignee: Nippon Steel Corporation, Tokyo, Japan

[21] Appl. No.: 752,083

[22] Filed: Jul. 3, 1985

[30] Foreign Application Priority Data

| | | | |
|---|---|---|---|
| Jul. 9, 1984 | [JP] | Japan | 59-140692 |
| Jul. 13, 1984 | [JP] | Japan | 59-145706 |
| Jul. 18, 1984 | [JP] | Japan | 59-147668 |

[51] Int. Cl.[4] ..... C21D 8/02

[52] U.S. Cl. ..... 148/2; 72/366; 148/12 C; 148/12 D; 148/12.3

[58] Field of Search ..... 148/2, 12 C, 12 D, 12.3; 72/366

[56] References Cited

U.S. PATENT DOCUMENTS

| | | | |
|---|---|---|---|
| 3,839,095 | 10/1974 | Kubotera et al. | 148/2 |
| 4,040,873 | 8/1977 | Nakaoka et al. | 148/12 C |
| 4,113,517 | 9/1978 | Nakaoka et al. | 148/12 C |
| 4,374,682 | 2/1983 | Abe et al. | 148/12 C |
| 4,391,653 | 7/1983 | Takechi et al. | 148/12 C |

OTHER PUBLICATIONS

*The Making, Shaping and Treating of Steel,* United States Steel, 1971, p. 1000.

*Primary Examiner*—L. Dewayne Rutledge
*Assistant Examiner*—Robert L. McDowell
*Attorney, Agent, or Firm*—Wenderoth, Lind & Ponack

[57] ABSTRACT

Steel blackplate for surface treatment, having a soft temper degree of T-3 or less, and improved fluting resistance is produced by the combination of a chemical composition of 0.01% to 0.08% carbon, 0.015% or less phosphorus, without titanium and niobium; steelmaking without vacuum-degassing; a low slab-heating temperature of 1240° C. or less; a coiling temperature of 620° C. to 710° C.; continuous annealing having a heat pattern to decrease the solute carbon and nitrogen; and skin-pass rolling.

6 Claims, 5 Drawing Figures

PROCESS FOR PRODUCING, BY CONTINUOUS ANNEALING, SOFT BLACKPLATE FOR SURFACE TREATMENT

BACKGROUND OF THE INVENTION

1. Field of the Invention

The present invention relates to a process for producing a soft blackplate with a temper of T-3 or less to be subjected to surface treatment, such as tin-plating or chromic-acid treatment. More particularly, the present invention relates to a method for producing a soft blackplate for surface treatment (below, simply blackplate) by continuous annealing without the aid of decarburization by vacuum-degassing during the steel-making and without additive elements such as Ti, Nb. Still more particularly the present invention relates to a method for the producing a blackplate exhibiting soft properties and improved fluting resistance.

2. Description of the Related Art

The "temper degree" is an index defined by Japan Industrial Standard (JIS) G 3303 enabling selection of a blackplate for surface treatment, such as tin plating, having the desired material properties. The temper degree is expressed in terms of Rockwell superficial hardness ($H_R30T$ or $H_R15T$) with T-1: 46 to 52; T-2: 50 to 56; T-3: 54 to 60; T-4: 58 to 64; T-5: 62 to 68; and T-6: 67 to 73 in the sequence of soft to hard temper.

Usually a blackplate is produced by hot-rolling a low-carbon steel slab, cold-rolling a hot-rolled coil to a predetermined gauge, annealing, and skin-pass rolling. Tin plate is produced by tin-plating the blackplate. The annealing may be batch or continuous. Blackplate having a temper degree of T-1 to T-3 are conventionally produced by batch annealing. JIS also stipulates the production of blackplates having a temper degree of T-1 to T-3 to be by batch annealing, not continuous annealing. Since the heat cycles in continuous annealing are rapid heating, short-time holding, and rapid cooling, continuous annealing is conventionally applied for producing a blackplate having temper degree of $T_4$ or more. Clearly, continuous annealing is advantageous over batch annealing in its high productivity, uniformity of quality, energy savings, labor savings, and a shorter delivery time. Accordingly, various methods have recently been considered for producing a soft blackplate having a temper degree of T-3 or less by continuous annealing.

It is well known that, for producing soft steel-sheets, including cold-rolled steel sheets, it is important to (a) coarsen the grain size, (b) decrease the solute carbon remaining in the matrix after annealing, (c) and decrease the solute nitrogen remaining in the matrix after annealing. In addition to these metallurgical factors, attention must be paid to the hardening amount in skin-pass rolling and subsequent steps. That is, with ordinary cold-rolled sheets, the final step for determining material properties is the skin-pass rolling. On the other hand, for example, with tin plate, the tin-plating step and the step of fusing the tin-layer for providing the surface lustre determine the final material properties, for example, the fusion inducing strain-aging hardening at a high temperature. For producing a soft blackplate for tin-plating by means of continuous annealing, it is therefore important not only to avoid hardening by grain-refinement and solid solution hardening by carbon and nitrogen, to soften the annealed sheet, but also to drastically decrease the solute carbon and nitrogen remaining in the annealed sheet to avoid strain-aging hardening during, for example, the fusion of the tin-layer.

In can production, soft blackplate steel sheets such as tin plate and tin-free steel (TFS) undergo blanking, painting, printing, and baking steps before and shaping. Since the steel is subjected, during the baking, to heat treatment of, for example, 180° C. to 210° C. for 10 to 20 minutes, severe aging is generated. The blackplate must, notwithstanding such aging withstand all the shaping work, i.e., drum-shaping, edge-working, flange-working, and seaming. In addition the worked surface of the steel sheet must not have folds due to aging, and there must be no fluting, i.e., buckling of the surface into polygonal lines during bending.

For preventing grain refinement (a), Japanese Examined Patent Publication (Kokoku) No. 55-48574 discloses, for example, to finish the hot-rolling at a low temperature of 700° C. to $Ar_3$, and Japanese Unexamined Patent Publication (Kokai) No. 58-27932, discloses to carry out the continuous annealing at a temperature of 680° C. or more. For decreasing the solute carbon after the final annealing (b), Japanese Examined Patent Publication No. 55-48574 and Japanese Unexamined Patent Publication No. 58-27932 propose to carry out overaging treatment during the cooling from the soaking temperature. For decreasing the solute nitrogen, Japanese Unexamined Patent Publication No. 58-48574 and Japanese Unexamined Patent Publication No. 58-27932, for example, propose Al incorporation and Japanese Unexamined Patent Publication No. 58-187224 proposes addition of niobium.

The above proposals have been recently used for producing, by continuous annealing, a blackplates having a temper degree of T-3 or less. Nevertheless, they are only limitedly effective for stably producing blackplates. Therefore, decarburization by vacuum degassing is carried out at the steelmaking stage. In addition, the niobium incorporation is carried out such that the solute carbon and solute nitrogen are completely fixed. The cost increase due to the vacuum degassing and the addition of Nb offset the advantages of blackplates produced by conventional continuous annealing over backplates produced by batch-type annealing. Continuously annealed blackplates are currently being produced and marketed, but also still suffer from fluting. These problems should be eliminated so that can producers can carry out shaping after the painting, printing and baking without fluting.

SUMMARY OF THE INVENTION

It is an object of the present invention to stably produce a soft blackplate for surface treatment by continuous annealing without decarburization by vacuum degassing or addition of titanium, niobium or other additive elements.

It is another object of the present invention to produce a soft blackplate for surface treatment, which increases only slightly in hardness during a treatment process, such as tin-layer fusion, where strain-aging is induced.

It is a further object of the present invention to produce a blackplate for surface treatment, which does not exhibit fluting and which exhibits excellent workability even after exposure to severe aging treatment, such as painting and baking.

In accordance with one aspect of the present invention, there is provided a process for producing a soft blackplate for surface treatment, comprising the steps of: obtaining an aluminum-killed steel containing, by weight percentage, from 0.01% to 0.08% of carbon, from 0.05% to 0.60% of manganese, 0.02% or less of phosphorus, from 0.005% to 0.10% of acid-soluble aluminum, and 0.01% or less of N, the balance being essentially iron; forming a slab of the aluminum-killed steel by either continuous casting or ingot-making followed by rough-rolling; heating the slab to a temperature of 1240° C. or less; hot-rolling the heated slab to form a strip; coiling the strip at a temperature of from 620° C. to 710° C.; cold-rolling the hot-rolled strip to form a cold-rolled strip; continuously annealing the cold-rolled strip, wherein soaking is carried out at a temperature of from $Ac_1$ to 800° C. followed by slow cooling down to a temperature of from 650° C. to 730° C., and then cooling at a cooling speed (V°C./sec) of more than 30° C./sec down to an end temperature of cooling being in a range of from 100° C. to 250° C. and determined by $(100\times\log V-30)$°C. or less, and subsequently reheating is carried out to an overaging treatment temperature and the overaging is carried out at a temperature of from 250° C. to 450° C. for 30 seconds or more; and skin-pass rolling at a reduction rate of from 0.2% to 6.0%.

In accordance with another aspect of the present invention, there is provided a process for producing a soft blackplate for surface treatment, identical to the above, except in the continuous annealing of the cold-rolled strip, soaking is carried out by holding at a temperature of from 650° C. to 710° C. for 10 to 300 seconds, cooling at a speed of from 30° C. to 300° C./sec down to a temperature of 500° C. or less, and, subsequently overaging is carried out at a temperature of from 300° C. to 500° C.

BRIEF DESCRIPTION OF THE DRAWINGS

The present invention will now be further described with reference to the drawings, wherein.

DESCRIPTION OF THE PREFERRED EMBODIMENTS

Figure 1:
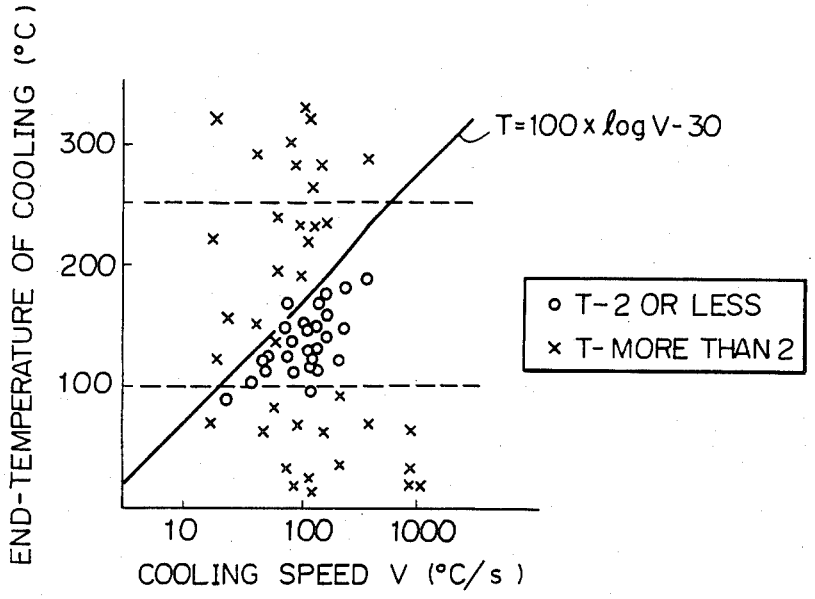
FIG. 1 is a graph of the cooling speed and the end-temperature of cooling in continuous annealing, which speed and end-temperature provide hardness of $H_R30T$ of 56 or less by aging treatment corresponding to fusion treatment of a tin-layer on a steel sheet.

In the present invention, the steel composition is characterized in that the steel is aluminum-killed steel with a low carbon content of from 0.01% to 0.08% by weight (hereinafter referred to as percent (%)) and a restricted phosphorus content of 0.020% or less. The steel may contain boron in an amount such that boron/-nitrogen ranges from 0.5 to 1.0.

Carbon can be decreased to the ultralow level of 0.008% or less by the vacuum-degassing of molten steel, but this increases the cost. The carbon content of 0.01% or more is determined so as to allow softening by the continuous annealing. When the carbon amount is high, growth of grains is impeded, and the annealed steel sheet has a hard temper already at the annealing step due to dispersion hardening by cementite. The highest carbon content is 0.08% in the light of attaining an appropriate hardness at the annealing step.

Manganese is present in an amount of at least 0.05% so as to prevent hot embrittlement. When the manganese content is high, the solid-solution hardening due to manganese increases the hardness. The highest manganese content is therefore 0.60%.

Phosphorus exerts a great influence upon the hardness of annealed sheets. Therefore, the phosphorus content is set at 0.02% or less so as to provide the temper degree of T-3 or less for the products.

Aluminum fixes solute nitrogen as AlN. At least 0.005% of acid-soluble aluminum is necessary for fixing nitrogen. When the aluminum amount is increased, the amount of the $Al_2O_3$-bearing inclusions, which cause flange-cracks, is increased, and the cost is enhanced. The highest acid-soluble aluminum content is therefore 0.10%.

Nitrogen causes the solid-solution hardening in steps prior to annealing and strain-aging hardening in the skin-pass rolling and subsequent steps, the product sheet being hardened by any of these reasons. The highest nitrogen content is therefore 0.01%.

Boron is an optional element added if necessary. When boron is added, BN precipitates during the hot-rolling. The formation of BN precipitates is more effective for fixing nitrogen than aluminum. In order to attain such an effect, the boron must be added to steel in a weight proportion boron/nitrogen in the range of from 0.5 to 1.0.

The rolling is characterized in that a slab is obtained by continuous casting or ingot-making followed by rough rolling. The slab is heated directly or after cooling down to $Ar_1$ or less, to a temperature of 1240° C. at the highest (low temperature slab-heating), and is then hot-rolled. The hot-rolled strip is coiled at a temperature of from 620° C. to 710° C. The hot-rolled strip is then cold-rolled.

Specifically, the starting material of hot-rolling is a slab which may be produced by an ingot-making and rough rolling method or continuous casting method. The slab heating prior to hot-rolling is carried out in such a manner that, AlN which is formed during the slab production is not again dissolved. During the slab heating, the AlN precipitation also occurs, the size of AlN precipitates is controlled relatively large so that the grain growth is not impeded by AlN during the hot-rolling and subsequent steps. In order to attain the size control and prevent the AlN solution, the heating temperature is determined as 1240° C. or less. The lower the heating temperature, the more advantageous for the size control and prevention of AlN solution and the less advantageous for the hot-rolling operation. The lowest heating temperature is 950° C. In the slab heating, the slab produced and then cooled down to $Ar_1$ or less may be reheated to the heating temperature described above. In this method the cooling down to $Ar_1$ or less is utilized to precipitate AlN in a large shape. The reheating temperature is limited to 950° C. to 1240° C. because of the reasons as described above, i.e., the prevention of AlN solution and AlN-size control.

The finishing temperature of hot-rolling is not specified, but the temperature of coiling after hot-rolling is from 620° C. to 710° C. The lowest coiling temperature is determined so as to precipitate solute [N] remaining in the steel matrix of a slab and also to promote the grain-growth by coarsening the grains. At a coiling temperature of 710° C. more more, the grains are further coarsened but at the same time the carbides coagulate and become spheroidal. Such carbide spheroidization impairs the corrosion-resistance of the product and the can-workability, particularly the flange workability.

When the slab is heated and then hot-rolled as described above, the nitrogen precipitates as AlN leaving only 10 ppm or less of nitrogen as solute nitrogen. The AlN morphology is not fine but coarse precipitates, so that the growth of grains is not impeded by AlN, and thereby obtaining coarse grains. Carbon is uniformly distributed as cementite in the string or spheroid form.

The hot-rolled steel strip obtained as described above is descaled and then cold-rolled at a reduction rate of 80% or more to obtain a gauge of a blackplate for, for example, tin plate, e.g., 0.45 mm or less. Next, continuous annealing is carried out.

The continuous annealing is characterized in that the soaking temperature is from $AC_1$ to 800° C. Slow cooling is carried out at a temperature between the soaking temperature and a temperature of from 650° C. to 730° C. From this temperature, the cooling down to a temperature of 100° C. to 250° C. is carried out at a rate (V°C./second) more than 30° C./second and having a specific relationship with the end temperature cooling. Subsequently, either overaging is carried out by heating up to a temperature of 250° C. to 450° C., or, in the case of slab-cooling down to $Ar_1$ or less followed by reheating, soaking at a temperature of from 620° C. to 710° C. is carried out and then the overaging treatment is carried out by cooling at a cooling speed of from 30° C. to 500° C./second.

Specifically, heating up to a temperature of from $Ac_1$ to 800° C. and soaking are carried out to satisfactorily recrystallize and re-solid-dissolve the carbide precipitated in the hot-rolled strip. Heating at a temperature more than a recrystallization temperature is sufficient for recrystallizing. Nevertheless, heating up to $Ac_1$ or more is necessary for re-solid dissolving the carbides precipitated during the hot-rolling step in a short period of time in the continuous annealing and for increasing the amount of solute carbon before the cooling, to a level of supersaturation. This solute carbon should be supersaturated in order to enhance the overaging effect. On the other hand, when the soaking temperature is high, the strength of a steel strip being conveyed is lessened, so that operation accidents and shape failures may result. In light of these points, the highest soaking temperature is determined as 800° C.

After soaking, slow cooling down to a temperature of 650° C. to 730° C. is carried out to provide the largest amount of solute carbon in the ferrite phases. The ferrite phases should contain as much solute carbon as possible, and such solute carbon should be decreased effectively in the subsequent cooling and overaging steps, thereby preventing a hardness increase due to aging in the surface treatment and the like. Slow cooling at a temperature more than 730° C. or less than 650° C. causes a decrease in the solute carbon in the ferrite phases and makes the subsequent cooling and overaging less effective. The slow cooling should be carried out at a speed of 20° C./sec or less. After the slow cooling, cooling down to an end-temperature of cooling (T) is carried out. This temperature is from 100° C. to 250° C. and is less than the overaging temperature. It is important that the cooling speed down to the end-temperature of cooling (T) be 30° C./second or more and have the following relationship with the end-temperature of cooling (T):

$$T \leqq 100 \times \log_{10} V - 30.$$

The overaging is subsequently carried out by reheating up to a temperature of from 250° C. to 450° C. and holding for 30 seconds or more at this temperature.

Figure 2:
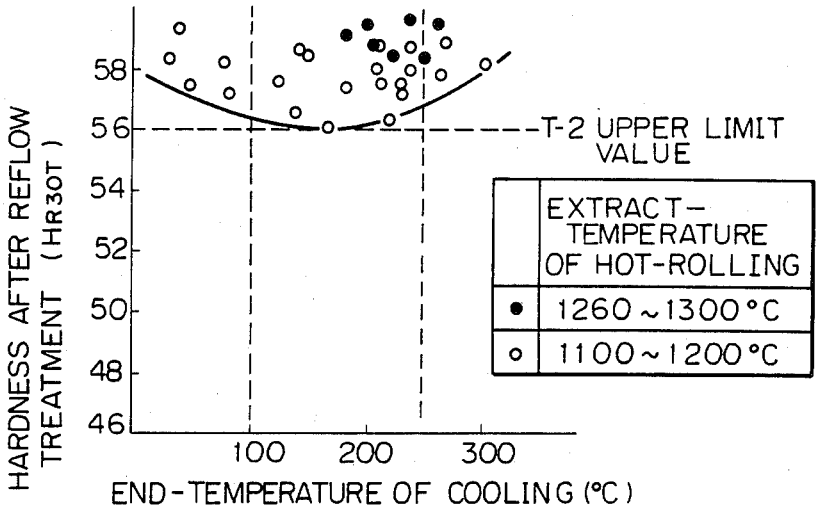
FIG. 2 shows the relationship between the cooling-end temperature in continuous annealing and hardness after aging (shown in FIG. 2 as the hardness after reflow treatment), the heat condition of which corresponds to that of the fusion-treatment of tin-layer.
Figure 3:
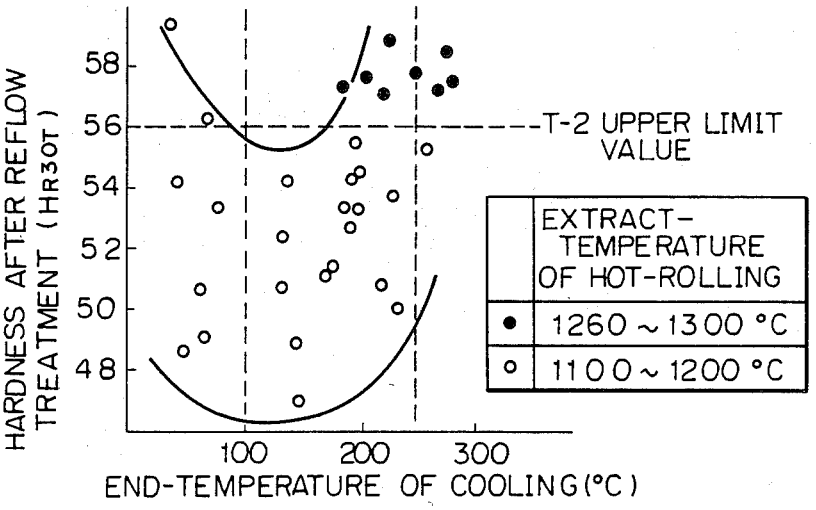
FIG. 3 is a graph similar to FIG. 2.

Referring to FIGS. 1, 2, and 3,, experiments for determining important annealing conditions are illustrated. In these experiments, the steels tested contained 0.008% to 0.034% of carbon, 0.18% to 0.35% of manganese, 0.006% to 0.015% of phosphorus, 0.031% to 0.083% of Sol.Al as the basic elements. Two slab-heating temperatures, i.e., a low temperature of 1050° C. to 1200° C. and a high temperature of 1260° C. to 1300° C., were used. The hot-rolling was carried out at a finishing temperature of 800° C. to 860° C. and a coiling temperature of 640° C. to 700° C. Cold-rolling was carried out to obtain 0.35 mm thick strips. The conditions for continuous annealing were a soaking temperature of 750° C. to 800° C.; slow cooling down to 680° C.; varied cooling speeds V and end-temperatures of cooling; and overaging at 400° C. for 1 minute. Subsequently, skin-pass rolling was carried out at a reduction rate of 1.5% to 5%, and aging at a temperature of 250° C. was carried out for 9 seconds. The aging condition corresponds to the thermal condition during the fusion step of a tin layer (reflow). The hardness HR30T was measured after aging.

As is apparent from FIGS. 1, 2, and 3, it is difficult to obtain a soft temper degree of T-3 or less when the end-temperature of cooling is low, or less than 100° C., or when the end-temperature of cooling is high, or more than 250° C., and the cooling speed V is less than 30° C./sec, since the subsequent overaging treatment cannot prevent a great increase in the hardness during the surface treatment (reflow). As is apparent from FIG. 1, an end-temperature of cooling ranging from 100° C. to 250° C. and a cooling rate of 30° C./sec cannot attain a temper degree of T-3 or less if the cooling speed V is small and the end-temperature of cooling is relatively high. When the cooling speed is small and the end-temperature of cooling is relatively high, it appears that the carbon supersaturation degree at the completion of cooling is relatively small, and hence the cementites in the grain, which behaves as nuclei of prompt carbon precipitation, are overaged and do not form prior to initiation of overaging. The relationship $T = 100 \times \log V - 30$ shown in FIG. 1 was empirically determined to attain effective overaging.

As is apparent from FIG. 3, the data of symbols with a "•" (1260° C. to 1300° C. of extract temperature of a slab-heating furnace) indicate that, notwithstanding the cooling speed (V) and end-temperature of cooling (T) falling within the range of the present invention, HR30T exceeds 56 and thus the soft temper degree of T-2 is not obtained.

The lowest overaging temperature of 250° C. is determined to decrease the solute carbon in a short period of time. The highest overaging temperature of 450° C. is the temperature at which the equilibrium solute amount of carbon is not great and hence a small amount of solute carbon is attained. At least 30 seconds are necessary for completely precipitating the supersaturated carbon.

Other conditions for continuous annealing which may be employed are as follows. The soaking is carried out at a temperature of from 620° C. to 710° C. and holding within 300 seconds. Then a rapid cooling from the soaking temperature is carried out at a speed of from 30° C. to 500° C./sec down to an overaging temperature of from 300° C. to 500° C.

Subsequent to the overaging treatment, the steel strip is cooled to a temperature where skin-pass rolling is possible, and the skin-pass rolling is carried out to control the temper degree and to adjust the sheet shape. The above features make it possible produce soft blackplate having a temper degree of T-3 or less, in which the solute carbon and nitrogen are drastically decreased and the hardness increase during, e.g., fusion of the tin layer, is suppressed to a degree to an equivalent or superior to the case where strong carbide-and nitride former(s), such as titanium and niobium, are added and in which the fluting resistance is enhanced.

To provide an extra-soft temper degree of T-1, a reduction rate of 0.2% or more is necessary. The highest reduction rate of 0.6% is determined not to excessively harden the product but to obtain the soft temper degree of T-3. The skin-pass rolling is preferably carried out at a high screwdown load of 1.7 ton/mm or more to prevent fluting. The skin-pass rolls preferably have a small roll-diameter of 470 mm or less. The screwdown force of skin-pass rolling induces into the strip surface deformation bands and increases the density of movable dislocation, thereby preventing fluting. This is explained with reference to experimental data. Aluminum-killed steel containing 0.02% to 0.04% of carbon, 0.15% to 0.25% of manganese, 0.005% to 0.016% of phosphorus, 0.050% to 0.080% of solute aluminum, and 0.0030% to 0.0060% of nitrogen was tested. Continuously cast slab of the same was cooled to 560° C. and reheated to a temmperature of 1060° C. Hot-rolling was carried out at finishing temperature of 870° C. and a coiling temperature of 680° C. Cold-rolling was carried out to obtain 0.30 mm thick strips. The conditions for continuous annealing were a soaking at 700° C. for 50 seconds; slow cooling down to 680° C.; and overaging at 400° C. for 60 seconds. Subsequently, skin-pass rolling was carried out by varying the screwdown force per unit width of the strip. The skin-pass rolled strips were subjected to bending with a radius of 40 mm. Fluting was observed. The methods for testing and evaluating the fluting resistance are described hereinbelow.

Figure 4:
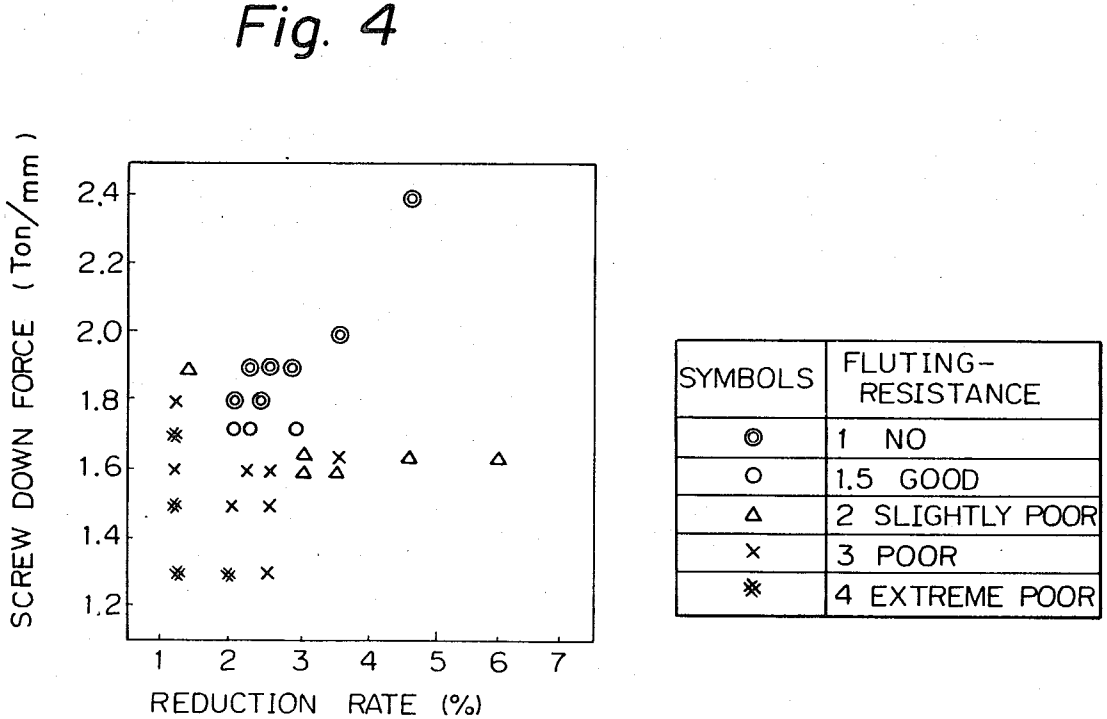
FIG. 4 illustrates data of experiments for determining the influence of the screw down force at the skin-pass rolling upon the fluting resistance.

As is apparent from FIG. 4, fluting does not occur at a screwdown force more than 1.7 ton/mm, and the reduction rate is preferably 1.5% or more. FIG. 4 also reveals that at an identical reduction rate, fluting does not occur when the screwdown force is more than 1.7 ton/mm. This appears to result in that the skin-pass rolling, which predominantly imparts to a steel sheet not tensional force but screwdown force, induces a shape of dislocations such that the solute carbon and nitrogen atoms are forced to be fixed by the dislocations.

Subsequent to the skin-pass rolling, the steel sheet is subjected to surface treatment, e.g., tin-plating or chromic-acid treatment.

The present invention is explained further by way of examples.

Example 1

Specimens having the compositions given in Table 1 were treated under the conditions given in Table 1 to produce steel sheets (blackplate) for surface treatment. These sheets were then subjected to artificial aging at 250° C. (temperature corresponding to reflow treatment) for 9 seconds. The hardnesses of the artificially aged steel sheets are given in Table 1.

TABLE 1

| | | Chemical Components (wt %) | | | | | | | | | Hot-Rolling Conditions | | |
|---|---|---|---|---|---|---|---|---|---|---|---|---|---|
| Distinction | Sample Nos. | C | Si | Mn | P | S | Acid-soluble Al | N | B | B/N | Extracting Temperature °C. | Coiling Temperature °C. | Soaking Temperature °C. |
| Inventive steels | 1 | 0.026 | 0.01 | 0.22 | 0.009 | 0.009 | 0.060 | 0.0030 | — | — | 1100 | 670 | 750 |
| | 2 | 0.022 | 0.01 | 0.21 | 0.006 | 0.010 | 0.058 | 0.0039 | — | — | 1100 | 670 | 790 |
| | 3 | 0.039 | 0.01 | 0.24 | 0.008 | 0.008 | 0.061 | 0.0038 | — | — | 1100 | 670 | 740 |
| | 4 | 0.017 | 0.02 | 0.08 | 0.010 | 0.008 | 0.008 | 0.0017 | — | — | 1050 | 690 | 750 |
| | 5 | 0.033 | 0.02 | 0.51 | 0.015 | 0.011 | 0.076 | 0.0070 | — | — | 1240 | 630 | 800 |
| | 6 | 0.038 | 0.01 | 0.09 | 0.008 | 0.006 | 0.082 | 0.0041 | — | — | 1050 | 700 | 800 |
| | 7 | 0.037 | 0.01 | 0.26 | 0.012 | 0.011 | 0.074 | 0.0035 | — | — | 1200 | 700 | 750 |
| | 8 | 0.037 | 0.01 | 0.35 | 0.010 | 0.007 | 0.042 | 0.0024 | 0.0013 | 0.54 | 1140 | 650 | 730 |
| | 9 | 0.028 | 0.01 | 0.21 | 0.011 | 0.009 | 0.013 | 0.0025 | 0.0022 | 0.88 | 1075 | 640 | 775 |
| Comparative Steels | 10 | 0.021 | 0.01 | 0.22 | 0.009 | 0.009 | 0.060 | 0.0030 | — | — | 1100 | 670 | 680 |
| | 11 | 0.074 | 0.01 | 0.80 | 0.018 | 0.011 | 0.076 | 0.0084 | — | — | 1260 | 550 | 750 |

| | | Continuous Annealing Conditions | | | | Skin-pass sheet product | | |
|---|---|---|---|---|---|---|---|---|
| Distinction | Sample Nos. | Initiation Temperature of Rapid Cooling °C. | Cooling Speed °C./S | End Temerature of Cooling °C. | Overaging Temperature °C. | Overaging time S | Reduction Rate % | Hardness (HR 30T) |
| Inventive Steels | 1 | 700 | 100 | 150 | 350 | 120 | 3.00 | 50.8 |
| | 2 | 660 | 30 | 110 | 270 | 480 | 1.72 | 49.1 |
| | 3 | 730 | 300 | 200 | 450 | 30 | 3.02 | 50.9 |
| | 4 | 680 | 150 | 170 | 400 | 60 | 0.21 | 47.0 |
| | 5 | 650 | 50 | 120 | 400 | 180 | 1.50 | 48.8 |
| | 6 | 650 | 200 | 190 | 300 | 480 | 5.98 | 55.2 |
| | 7 | 700 | 400 | 250 | 300 | 480 | 5.71 | 54.6 |
| | 8 | 700 | 140 | 150 | 370 | 120 | 2.23 | 49.8 |
| | 9 | 710 | 100 | 150 | 350 | 180 | 4.18 | 52.5 |
| Comparative Steels | 10 | 650 | 20 | 400 | 400 | 120 | 2.51 | 57.5 |
| | 11 | 700 | 100 | 150 | 350 | 120 | 2.50 | 62.4 |

As is apparent from Table 1, the steel sheets according to the present invention have an ultra-soft temper degree of T-2 or less for blackplate. On the other hand, the comparative steels, which do not satisfy the requirements according to the present invention, exceed HR30T=50, which is the highest specified value of the temper degree T-2 and a hard temper.

TABLE 2

| Sample Nos. | Chemical Composition (wt %) C | Mn | Acid-soluble Al | N | P | Slab-Cooling Temperature (°C.) | Slab-Heating Temperature (°C.) | Hot-Rolling Conditions: Finishing Temperature (°C.) | Coiling Temperature (°C.) | Continuous Annealing Conditions: Soaking Temperature (°C.) | Holding Time (S) |
|---|---|---|---|---|---|---|---|---|---|---|---|
| 1 | 0.019 | 0.33 | 0.031 | 0.0030 | 0.008 | 120 | 1050 | 890 | 690 | 705 | 50 |
| 2 | 0.031 | 0.25 | 0.050 | 0.0040 | 0.012 | 565 | 1040 | 880 | 680 | 695 | 55 |
| 3 | 0.026 | 0.22 | 0.065 | 0.0045 | 0.012 | 440 | 1050 | 880 | 690 | 700 | 50 |
| 4 | 0.043 | 0.25 | 0.042 | 0.0050 | 0.016 | 250 | 1020 | 870 | 670 | 700 | 45 |
| 5 | 0.043 | 0.25 | 0.042 | 0.0050 | 0.010 | 250 | 1020 | 870 | 670 | 700 | 45 |
| 6 | 0.062 | 0.21 | 0.055 | 0.0035 | 0.006 | 400 | 1060 | 890 | 690 | 700 | 50 |
| 7 | 0.062 | 0.33 | 0.031 | 0.0050 | 0.011 | 560 | 1090 | 880 | 660 | 705 | 50 |
| 8 | 0.031 | 0.33 | 0.035 | 0.0055 | 0.015 | 600 | 1020 | 870 | 690 | 700 | 50 |
| 9 | 0.019 | 0.21 | 0.062 | 0.0040 | 0.011 | 350 | 1000 | 870 | 680 | 705 | 50 |
| 10 | 0.043 | 0.26 | 0.030 | 0.0040 | 0.009 | 200 | 1060 | 890 | 690 | 700 | 40 |
| 11 | 0.025 | 0.28 | 0.050 | 0.0050 | 0.016 | 320 | 1040 | 880 | 700 | 705 | 50 |
| 12 | 0.045 | 0.21 | 0.050 | 0.0040 | 0.015 | 450 | 1020 | 880 | 705 | 700 | 50 |
| 13 | 0.031 | 0.21 | 0.050 | 0.0040 | 0.013 | 900 | 1100 | 890 | 675 | 700 | 50 |
| 14 | 0.019 | 0.21 | 0.060 | 0.0068 | 0.012 | 450 | 1080 | 880 | 680 | 705 | 50 |
| 15 | 0.019 | 0.33 | 0.042 | 0.0030 | 0.016 | 55 | 1060 | 890 | 530 | 700 | 50 |
| 16 | 0.026 | 0.21 | 0.062 | 0.0040 | 0.014 | 100 | 1260 | 880 | 685 | 700 | 50 |
| 17 | 0.120 | 0.23 | 0.051 | 0.0035 | 0.012 | 85 | 1050 | 890 | 670 | 700 | 50 |
| 18 | 0.026 | 0.22 | 0.065 | 0.0045 | 0.010 | 845 | 1050 | 880 | 680 | 700 | 50 |
| 19 | 0.026 | 0.22 | 0.065 | 0.0045 | 0.014 | 40 | 1050 | 880 | 680 | 700 | 50 |

| Sample Nos. | Continuous Annealing Conditions: Cooling Speed (°C./S) | Overaging Temperture (°C.) | Skin Pass Rolling: Screwdown Force (Ton/mm) | Reduction Rate (%) | Hardness (HR 30T) | Fluting Evaluation | Remarks |
|---|---|---|---|---|---|---|---|
| 1 | 30 | 405 | 1.8 | 2.2 | 53 | 1 | Invention |
| 2 | 32 | 395 | 1.9 | 2.5 | 55 | 1 | " |
| 3 | 30 | 400 | 1.7 | 2.8 | 55 | 1.5 | " |
| 4 | 30 | 400 | 2.0 | 3.5 | 56 | 1 | " |
| 5 | 30 | 400 | 1.8 | 2.0 | 53 | 1.5 | " |
| 6 | 30 | 400 | 1.9 | 2.6 | 55 | 1 | " |
| 7 | 30 | 395 | 1.8 | 2.1 | 53 | 1 | " |
| 8 | 30 | 400 | 1.9 | 2.3 | 54 | 1 | " |
| 9 | 35 | 400 | 1.7 | 2.2 | 52 | 1 | " |
| 10 | 50 | 390 | 1.8 | 2.5 | 54 | 1 | " |
| 11 | 40 | 395 | 2.0 | 3.5 | 56 | 1 | " |
| 12 | 30 | 400 | 2.4 | 4.5 | 57 | 1 | " |
| 13 | 30 | 400 | 1.8 | 2.2 | 59 | 4 | Comparative Example |
| 14 | 30 | 400 | 1.8 | 2.3 | 60 | 3 | Comparative Example |
| 15 | 30 | 405 | 1.7 | 2.1 | 59 | 2 | Comparative Example |
| 16 | 30 | 395 | 1.7 | 2.2 | 60 | 3 | Comparative Example |
| 17 | 30 | 400 | 1.7 | 2.2 | 63 | 2 | Comparative Example |
| 18 | 30 | 400 | 1.7 | 1.1 | 51 | 4 | Comparative Example |
| 19 | 30 | 400 | 1.3 | 2.5 | 54 | 3 | Comparative Example |

*Roll Diameter of Skin Pass Rolling: 420 mm

Example 2

Figure 5:
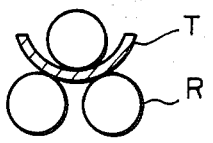
FIG. 5 illustrates the testing method of fluting.

Specimens having the compositions given in Table 2 were treated under the conditions given in Table 2 to produce blackplates for tin plating. These blackplates were then subjected to test of hardness and tests for fluting. In the fluting test, test samples of 3 inches (length in rolling direction)×5 inches (length along width of rolled article) were used. As shown in FIG. 5, three 40 mm diameter, cylindrical rolls (R) were used to bend the test samples (T) in a cylindrical form. The buckling on the bent part of the samples was observed with the naked eye and touch. The buckling degree is as evaluated as follows: 1; no-buckling; 1.5; good; 2; slightly poor; 3; poor; and 4; extremely poor.

As is apparent from Table 2, the specimens according to the present invention, do not suffer from fluting or have an improved fluting resistance.

We claim:

1. A process for producing a soft blackplate for surface treatment, comprising the steps of:

obtaining an aluminum-killed steel containing, by weight percentage, from 0.01% to 0.08% of carbon, from 0.05% to 0.60% of manganese, 0.02% or less of phosphorus, from 0.005% to 0.10% of acid-soluble aluminum, and 0.01% or less of nitrogen, the balance being essentially iron;

forming a slab of the aluminum-killed steel by continuous casting or ingot-making followed by rough-rolling;

heating the slab to a temperature of 950° C.–1240° C.;

hot-rolling the heated slab to form a strip;

coiling the strip at a temperature of from 620° C. to 710° C.;

cold-rolling the hot-rolled strip to form a cold-rolled strip;

continuously annealing the cold-rolled strip, wherein soaking is carried out at a temperature of from $Ac_1$ to 800° C. followed by slow cooling at a speed of 20° C. or less down to a temperature of from 650° C. to 730° C., and then cooling at a cooling speed (V/°C./sec) of 30° C./sec or more down to an end temperature range of from 100° C. to 250° C. but not higher than a temperature determined by $(100\times\log V-30)$°C. and then reheating the strip to an overaging treatment temperature of from 250° C. to 450° C. and subjecting the strip to said overaging treatment temperature of from 250° C. to 450° C. for 30 seconds or more; and skin-pass rolling at a draft of from 0.2% to 6.0%.

2. A process according to claim 1, wherein the aluminum-killed steel further contains boron in a weight ratio of boron/nitrogen in the range of from 0.5 to 1.0.

3. A process according to claim 1 or 3, wherein the skin-pass rolling is carried under a high screwdown load of 1.7 ton/mm or more.

4. A process according to claim 3, wherein the skin-pass rolling is carried out using small-diameter rolls having a roll-diameter of 470 mm or less.

5. A process according to claim 1 or 3, wherein the skin-pass rolling is carried out using a small-diameter rolls having a roll-diameter of 470 mm or less.

6. A process for producing a soft blackplate for surface treatment, comprising the steps of:

obtaining an aluminum-killed steel containing, by weight percentage, from 0.01% to 0.08% of carbon, from 0.05% to 0.60% of manganese, 0.02% or less of phosphorus, from 0.005% to 0.10% of acid-soluble aluminum, and 0.01% or less of nitrogen, the balance being essentially iron;

forming a slab of the aluminum-killed steel by continuous casting or ingot-making and rough-rolling to produce a slab containing AlN therein;

heating the slab to a temperature of 950° to 1240° C., such that the AlN formed during the slab forming step is not dissolved;

hot-rolling the heated slab to form a strip;

coiling the strip at a temperature of from 620° C. to 710° C., thereby precipitating solute remaining in the matrix as AlN;

cold-rolling the hot-rolled strip to form a cold-rolled strip;

continuously annealing the cold-rolled strip, wherein soaking is carried out at a temperature of from 620° C. to 710° C., and holding within 300 seconds followed by cooling the strip from the soaking temperature down to an overaging temperature at a speed of 30° C. to 500° C./sec, and subjecting the strip to an overaging treatment at an overaging temperature of from 300° C. to 500° C. for 30 seconds and more; and, skin-pass rolling at a draft of from 0.2 to 6.0%, wherein the skin-pass rolling is carried under a high screw-down load of 1.7 ton/mm or more and by using small-diameter rolls having a roll-diameter of 470 mm or less.

* * * * *